US008814612B2

(12) United States Patent
Onuma et al.

(10) Patent No.: US 8,814,612 B2
(45) Date of Patent: Aug. 26, 2014

(54) CRIMP TERMINAL

(75) Inventors: Masanori Onuma, Makinohara (JP); Kousuke Takemura, Makinohara (JP)

(73) Assignee: Yazaki Corporation, Tokyo (JP)

( * ) Notice: Subject to any disclaimer, the term of this patent is extended or adjusted under 35 U.S.C. 154(b) by 24 days.

(21) Appl. No.: 13/814,159

(22) PCT Filed: Jul. 14, 2011

(86) PCT No.: PCT/JP2011/066112

§ 371 (c)(1),
(2), (4) Date: Feb. 4, 2013

(87) PCT Pub. No.: WO2012/017802

PCT Pub. Date: Feb. 9, 2012

(65) Prior Publication Data

US 2013/0137315 A1 May 30, 2013

(30) Foreign Application Priority Data

Aug. 5, 2010 (JP) ..... 2010-176036

(51) Int. Cl.
*H01R 4/10* (2006.01)

(52) U.S. Cl.
USPC ..... 439/877

(58) Field of Classification Search
USPC ..... 439/877, 882
See application file for complete search history.

(56) References Cited

U.S. PATENT DOCUMENTS

| | | | | |
|---|---|---|---|---|
| 5,316,506 | A | 5/1994 | Ito | |
| 5,370,560 | A | 12/1994 | Ito | |
| 8,177,591 | B2 * | 5/2012 | Okamura et al. | 439/877 |
| 8,485,853 | B2 * | 7/2013 | Seifert et al. | 439/882 |

FOREIGN PATENT DOCUMENTS

| | | | |
|---|---|---|---|
| JP | 5-152011 | A | 6/1993 |
| JP | 2008-305571 | A | 12/2008 |
| JP | 2009-245695 | A | 10/2009 |
| JP | 2010-27463 | A | 2/2010 |

* cited by examiner

*Primary Examiner* — Phuong Dinh
(74) *Attorney, Agent, or Firm* — Sughrue Mion, PLLC

(57) ABSTRACT

A conductor crimp portion (11) before being crimped to a conductor of an electric wire includes, in an inner surface (11R) of the conductor crimp portion (11), circular recesses (20) as serrations of the conductor crimp portion (11) scattered to be spaced from each other. Each of the recesses (20) is formed through a press machining of the conductor crimp portion (11) by using a metal mold (70) with a protruded portion (72) formed, by a discharge machining, in a position corresponding to each of the recesses (20) or by using a metal mold with a protruded portion (85) formed, by press fitting a pin (83) into a press fit hole (82) formed in a block (81), in a position corresponding to each of the recesses (20).

2 Claims, 12 Drawing Sheets

(a)

(b)

CRIMP TERMINAL

TECHNICAL FIELD

The present invention relates, for example, to an open barrel type crimp terminal used for an electric system of an automobile and having a conductor crimp portion with a U-shape cross section.

BACKGROUND ART

FIG. 1 is a perspective view showing a structure of an associated crimp terminal described, for example, in PTL 1.

A crimp terminal 101 is provided with: in the front portion in the longitudinal direction of a terminal (also the longitudinal direction of a conductor of an electric wire to be connected), an electrical connection portion 110 to be connected to a terminal of a mating connector side; behind the electrical connection portion 110, a conductor crimp portion 111 to be crimped to an exposed conductor of an end of an electric wire (not shown); and still behind the conductor crimp portion 111, a coated crimping portion 112 to be crimped to a portion, of the electric wire, coated with an insulative coating. Between the electrical connection portion 110 and the conductor crimp portion 111 is provided a first connecting portion 113 for connecting the electrical connection portion 110 with the conductor crimp portion 111. Between the conductor crimp portion 111 and the coated crimping portion 112 is provided a second connecting portion 114 for connecting the conductor crimp portion 111 with the coated crimping portion 112.

The conductor crimp portion 111, which has a bottom plate 111A and a pair of conductor crimping pieces 111B, 111B provided to extend upwardly from right and left side edges of the bottom plate 111A and to be so crimped as to wrap the conductor of the electric wire positioned on an inner surface of the bottom plate 111A, is formed substantially into a U-shape in cross section. The coated crimping portion 112, which has a bottom plate 112A and a pair of coated crimping pieces 112B, 112B provided to extend upwardly from right and left side edges of the bottom plate 112A and to be so crimped as to wrap an electric wire (the portion with an insulative coating) positioned on an inner surface of the bottom plate 112A, is formed substantially into a U-shape in cross section.

The first connecting portion 113 on the front side of the conductor crimp portion 111 and the second connecting portion 114 on the rear side of the conductor crimp portion 111, which, respectively, have bottom plates 113A, 114A and low side plates 113B, 114B erect upwardly from right and left side edges of the bottom plates 113A, 114A, are each formed substantially into a U-shape in cross section.

A bottom plate in a range from a bottom plate (not shown) of the electrical connection portion 110 in the front portion to the coated crimping portion 112 in the rearmost portion (the bottom plate 113A of the first connecting portion 113, the bottom plate 111A of the conductor crimp portion 111, the bottom plate 114A of the second connecting portion 114, and the bottom plate 112A of the coated crimping portion 112) is formed continuously in a form of one piece of band plate. The front and rear ends of the low side plate 113B of the first connecting portion 113 are continuous with respective lower half portions at a rear end of a side plate (no reference numeral) of the electrical connection portion 110 and at a front end of the conductor crimping piece 111B of the conductor crimp portion 111, while the front and rear ends of the low side plate 114B of the second connecting portion 114 are continuous with respective lower half portions at a rear end of the conductor crimping piece 111B of the conductor crimp portion 111 and at a front end of the coated crimping piece 112B of the coated crimping portion 112.

Of an inner surface 111R and an outer surface 1115 of the conductor crimp portion 111, the inner surface 111R on a side contacting the conductor of the electric wire is provided with a plurality of serrations 120 each in a form of a recessed groove extending in a direction perpendicular to an extending direction of the conductor of the electric wire (longitudinal direction of the terminal).

FIG. 2 is a detail view of the serrations 120 formed on the inner surface of the conductor crimp portion 111, where FIG. 2(*a*) is a plan view showing a developed state of the conductor crimp portion 111, FIG. 2(*b*) is a cross sectional view taken along the line IIb-IIb in FIG. 2(*a*), and FIG. 2(*c*) is an enlarged view of a portion IIc in FIG. 2(*b*).

The cross sectional configuration of the serration 120 in the form of the recessed groove is either rectangular or inverted trapezoidal, where an inner bottom surface 120A is formed substantially parallel to an outer surface 1115 of the conductor crimp portion 111. An inner corner portion 120C where an inner side surface 120B intersects with the inner bottom surface 120A is formed as an angular portion where a plane intersects with a plane. A hole edge 120D where the inner side surface 120B intersects with the inner surface 111R of the conductor crimp portion 111 is formed as an angular edge.

In general, the conductor crimp portion 111 having the above serrations 120 is, as shown in FIG. 3, prepared through a press machining by using a metal mold 200 having protruded portions 220 (actually, one referred to as serration die assembled to an upper mold of a press metal mold) in positions corresponding to the serrations 120 each in a form of a recessed groove.

The metal mold 200 in this case, as shown in FIG. 4, has a protruded portion 220 which is linear. Therefore, by using a rotary grind stone, the metal mold 200 is prepared on an upper surface of a block 210 through a grinding process. FIG. 5 shows an external view of the metal mold 200.

For crimping the conductor crimp portion 111 of the crimp terminal 101 having the above structure to the conductor of the end of the electric wire, the crimp terminal 101 is mounted on a mounting surface (upper surface) of a not-shown lower mold (anvil), then the conductor of the electric wire is inserted between the conductor crimping pieces 111A of the conductor crimp portion 111, and then the conductor of the electric wire is mounted on the upper surface of the bottom plate 111A. Then, lowering the upper mold (crimper) relative to the lower mold allows a guide inclined surface of the upper mold to gradually bring down a distal end side of the conductor crimping piece 111B inwardly.

Then, with the upper mold (crimper) further lowered relative to the lower mold, finally, the distal end of the conductor crimping piece 1113 is so rounded, on a curved surface continuous from the guide inclined surface to a central mountain-shaped portion of the upper mold, as to be folded back to the conductor side, and the distal ends of the conductor crimping pieces 111B being frictionally mated with each other are made to eat into the conductor, to thereby crimp the conductor crimping piece 111B in such a manner as to wrap the conductor.

The above operations can connect, by the crimping, the conductor crimp portion 111 of the crimp terminal 101 to the conductor of the electric wire. With respect to the coated crimping portion 112 as well, the lower mold and the upper mold are used to gradually bend the coated crimping pieces 112B inwardly, to thereby crimp the coated crimping pieces 112B to a portion, of the electric wire, coated with the insulative coating. By these operations, the crimp terminal 101 can be electrically and mechanically connected to the electric wire.

In the crimp operation by the crimping, an applied pressure allows the conductor of the electric wire to enter into the serration 120 at the inner surface of the conductor crimp portion 111 while causing a plastic deformation, thus strengthening the joint between the crimp terminal 101 and the electric wire.

CITATION LIST

Patent Literature

Patent Literature 1: Japanese Unexamined Patent Publication No. 2009-245695 (FIG. 1)

SUMMARY OF INVENTION

Incidentally, with respect to the associated crimp terminal 101 set forth above, the inner surface 111R of the conductor crimp portion 111 was provided with the recessed groove-shaped serrations 120 intersecting with the extending direction of the electric wire. However, a sufficient contact conductivity was, as the case may be, not necessarily obtained.

That is, when the conductor crimp portion 111 is crimped to the conductor of the electric wire, the surface of the conductor caused to flow by the pressing force causes a frictional mating with the hole edge 120D of the serration 120 or the surface of the conductor entering into the serration 120 causes a frictional mating with the inner surface of the serration 120, and thereby an oxide film of the surface of the conductor is peeled off and an exposed newly-formed surface has a contact conduction with the terminal. In this respect, the associated serration 120, being linear, showed an effectiveness when the conductor of the electric wire flows in the longitudinal direction but failed to show an effectiveness when the conductor extends in directions other than the longitudinal direction. Thus, a sufficiently high contact conductivity was, as the case may be, not necessarily obtained.

In the case of using the metal mold prepared by the grinding, a roundness at a distal end peripheral edge of the protruded portion 220 of the metal mold 200 is likely to be small; thus, as shown in FIGS. 2(*b*), (*c*), such a problem was caused as that the inner corner portion 120C where the inner bottom surface 120A and inner side surface 120B of the serration 120 of the crimp terminal 101 intersect with each other becomes angular. Therefore, the conductor having entered into the serration 120 fails to sufficiently reach as far as the inner corner portion 120C in a state in which the conductor crimp portion 111 is crimped to the conductor of the electric wire, and, thus, it is liable to cause a gap to the inner corner portion 120C. Thus, there was such a fear as that, in the case where a large gap is caused between the inner corner portion 120C and the conductor of the electric wire, thermal shock, mechanical vibration or the like might affect the oxide film to grow with the gap as a start point to thereby lower the contact conductivity between the conductor and the crimp terminal 101.

When the metal mold prepared by grinding is used, inability to sharpen an outer peripheral edge of the rotary grinding stone for preventing a crack or gradual removal of an edge by wear by use enlarges a roundness at the root of the protruded portion 220 of the metal mold 200; as a result, a roundness of the hole edge 120D of the serration 120 of the crimp terminal 101 as a work was likely to become large. As the roundness of the hole edge 120D is enlarged, a failure is likely to be caused in the state after the crimping.

That is, the hole edge 120D of the serration 120 has such an operation as to hold down the conductor, which is about to be deformed in the forward-rearward direction, to thereby make the conductor immovable in the forward-rearward direction, thus promoting the frictional mating between the terminal and the conductor flowing in the serration 120 and the conductor extending in the forward-rearward direction outside the serration 120 so as to improve peeling property of the oxide film. However, when the roundness of the hole edge 120D is enlarged, the operation of the hole edge 120D becomes dull, and the conductor becomes likely to move when receiving the thermal shock or mechanical vibration, resulting in increase in the contact resistance between the terminal and the conductor.

It is an object of the present invention to provide a crimp terminal capable of maintaining the contact conductivity between a conductor and the terminal constantly high.

A first aspect of the present invention is a crimp terminal including: an electrical connection portion provided in a front portion in a longitudinal direction of the terminal; and a conductor crimp portion provided behind the electrical connection portion and crimped and connected to a conductor of an end of an electric wire, the conductor crimp portion having a cross section formed into a U-shape by a bottom plate and a pair of conductor crimping pieces provided to extend upwardly from both right and left side edges of the bottom plate and crimped to wrap the conductor disposed on an inner surface of the bottom plate, wherein the conductor crimp portion before being crimped to the conductor of the end of the electric wire includes, in an inner surface of the conductor crimp portion, circular recesses as serrations scattered to be spaced from each other, wherein each of the recesses is formed through a press machining of the conductor crimp portion by using a metal mold with a protruded portion formed, by a discharge machining, in a position corresponding to each of the recesses, and wherein each of the recesses has an inner periphery corner portion with a roundness corresponding to an outer periphery of a root of the protruded portion of the metal mold and a hole edge with a roundness corresponding to a peripheral edge of a distal end of the protruded portion of the metal mold.

The above first aspect can bring about the following effects.

That is, when the conductor crimp portion is crimped to the conductor of the electric wire by using the crimp terminal, the conductor of the electric wire, while causing a plastic deformation, enters into each of the small circular recesses provided, as serrations, at the inner surface of the conductor crimp portion, to thereby strengthen the joint between the terminal and the conductor. In this case, the surface of the conductor caused to flow by a pressing force has a frictional mating with the hole edge of each of the small circular recesses or the surface of the conductor entering into the recess causes a frictional mating with the inner side surface of the recess, thereby an oxide film of the surface of the conductor is peeled off, and an exposed newly generated surface has a contact conduction with the terminal. In addition, since many small circular recesses are so provided as to be scattered about, a total length of the hole edge of the recess brings about an effectiveness in scraping off the oxide film, irrespective of the extending direction of the conductor. Thus, the contact conduction effect by the exposure of the newly generated surface can be more increased than when the linear serration intersecting with the extending direction of the conductor of the electric wire is provided like the associated example.

In the case of the press machining of the linear serrations like the ones according to the associated example, it was necessary to preform the linear protruded portions in the press metal mold. Therefore, for machining of the protruded portion, there was no choice but to rely on the grinding. However, in the case of making, in the press metal mold, many small circular protruded portions for machining the serrations, it becomes easy to rely on a machining method other than the grinding.

For example, in the case of forming, in the press metal mold, linear protruded portions like the ones according to the associated example, for making the protruded portions by the discharge machining, it is necessary to preform linear recesses at the discharge electrode. However, as a matter of fact, forming of the linear recesses at the metal block was so difficult that it was not proper for the discharge machining. However, in the case of making, in the press metal mold, many small circular protruded portions for machining the serrations like the present invention, the protruded portions of the metal mold can be made with ease by the discharge machining. That is, only machining beforehand many small circular recesses (as round holes), by drilling, in the base material block of the electrode enables to transfer many small circular protruded portions to the metal mold.

Since many small circular recesses provided as the serrations are formed by pressing the conductor crimp portion by using the metal mold where the protruded portions are formed, by the discharge machining, in positions corresponding to the recesses, the crimp terminal according to the present invention can bring about the following advantages.

Implementing the discharge machining of the base material block of the press metal mold by using the electrode where the round holes are opened, with the drill, in the positions corresponding to the protruded portions of the press metal mold can produce the metal mold having the protruded portions in positions corresponding to the respective round holes. Then, press-machining the conductor crimp portion by using the metal mold enables to obtain the crimp terminal having, as serrations, the small circular recesses to which the protruded portions are transferred, at the inner surface of the conductor crimp portion. In this case, the distal end peripheral edge of each of the protruded portions of the metal mold produced by the discharge machining is naturally machined into a configuration with the roundness due to the characteristic of the discharge machining. The root outer periphery of each of the protruded portions of the press metal mold produced by the discharge machining is machined into a configuration with the small roundness corresponding to the hole edge of the round hole.

Thus, the hole edge of the small circular recess (of the conductor crimp portion) to which the protruded portion of the metal mold is transferred is machined into the configuration with the small roundness corresponding to the root outer periphery of the protruded portion, and the inner periphery corner portion of the small circular recess is machined into the configuration having the roundness corresponding to the distal end peripheral edge of the protruded portion.

As a result, at the time of the crimping, the conductor having entered into the small circular recess is allowed to smoothly flow along the large roundness of the inner periphery corner portion of the recess, thus enabling to reduce the gap caused to the inner periphery corner portion. There was a fear that, in the case of a large gap, the thermal shock, mechanical vibration or the like might affect the oxide film to grow with the gap as a start point to thereby lower the contact conductivity between the conductor and the terminal. However, reducing the gap can suppress the growth of the oxide film, thus enabling to maintain a good contact conduction performance for a long time.

Since the hole edge of the small circular recess is machined into the configuration having the small roundness corresponding to the root outer periphery of the protruded portion of the press metal mold, at the time of crimping, the contact pressure to the conductor by the hole edge is increased, the force for pressing the conductor which is about to be deformed in the forward-rearward direction is increased, and the frictional mating between the terminal and the conductor flowing into the recess or the conductor extending in the forward-rearward direction outside the recess can be promoted, thus enabling to better the peeling property of the oxide film. As a result, the contact resistance increase which may be caused when the thermal shock or the mechanical vibration is received can be suppressed, thus enabling to maintain the stable conduction performance.

Forming the completely circular protruded portion in the press metal mold makes the protruded portion hardly cracked, thus improving the durability of the metal mold. When the protruded portion of the metal mold is formed by the grinding, the roundness at the distal end peripheral edge of the protruded portion becomes small. Meanwhile, when the protruded portion of the press metal mold is formed by the discharge machining, the roundness at the distal end peripheral edge of the protruded portion becomes larger than the roundness obtained by the grinding. The larger roundness can prevent chipping (flying of the crack pieces) of the protruded portion of the press metal mold.

Since the conductor crimp portion of the crimp terminal is machined by using the press metal mold produced by the discharge machining, the surface roughness of the inner surface of the conductor crimp portion can be made rough, and the frictional force between the terminal and the conductor can be increased, thus enabling to suppress the increase of the contact resistance.

A second aspect of the present invention is a crimp terminal including: an electrical connection portion provided in a front portion in a longitudinal direction of the terminal; and a conductor crimp portion provided behind the electrical connection portion and crimped and connected to a conductor of an end of an electric wire, the conductor crimp portion having a cross section formed into a U-shape by a bottom plate and a pair of conductor crimping pieces provided to extend upwardly from both right and left side edges of the bottom plate and crimped to wrap the conductor disposed on an inner surface of the bottom plate, wherein the conductor crimp portion before being crimped to the conductor of the end of the electric wire includes, in an inner surface of the conductor crimp portion, circular recesses as serrations scattered to be spaced from each other, wherein each of the recesses is formed through a press machining of the conductor crimp portion by using a metal mold with a protruded portion formed, by press fitting a pin into a press fit hole formed in a block, in a position corresponding to each of the recesses, and wherein each of the recesses has an inner periphery corner portion with a roundness corresponding to a chamfer portion of a peripheral edge of a distal end of the pin and a hole edge formed with an erect edge corresponding to a chamfer portion provided at a hole edge of the press fit hole.

The above second aspect can bring about the following effects.

When the conductor crimp portion is crimped to the conductor of the electric wire by using the crimp terminal, the conductor of the electric wire, while causing a plastic deformation, enters into each of the small circular recesses provided, as serrations, on the inner surface of the conductor crimp portion, to thereby strengthen the joint between the terminal and the conductor. In this case, the surface of the conductor caused to flow by a pressing force has a frictional mating with the hole edge of each of the recesses, or the surface of the conductor entering into the recess causes a frictional mating with the inner side surface of the recess, thereby an oxide film of the surface of the conductor is peeled off and an exposed newly generated surface has a contact conduction with the terminal. In addition, since many small circular recesses are so provided as to be scattered about, a total length of the hole edge of the recess brings about an effectiveness in scraping off the oxide film, irrespective of the extending direction of the conductor. Thus, the contact conduction effect by the exposure of the newly generated surface can be more increased than when the linear serration intersecting with the extending direction of the conductor of the electric wire is provided like the associated example.

In the case of the press machining of the linear serrations like the ones according to the associated example, it is necessary to preform the linear protruded portions in the press metal mold. Therefore, the machining of the protruded portions had no choice but to rely on the grinding. However, in the case of machining many small circular protruded portions in the press metal mold for machining the serrations, it becomes easy to rely on a machining method other than the grinding.

For example, in the case of forming, in the press metal mold, the linear protruded portions like the ones according to the associated example, for making the protruded portions, by the press fitting of a rectangular die, it is necessary to preform the linear recesses at the base material bracket of the metal mold. However, as a matter of fact, forming of the linear recesses at the metal block was so difficult that it was not proper for implementing this machining method. However, in the case of making many small circular protruded portions in the press metal mold for machining the serrations like the present invention, the protruded portions of the metal mold can be made with ease by press fitting the cylindrical pin into the circular press fit hole formed at the base material block.

Since many small circular recesses provided as the serrations are formed by press-machining the conductor crimp portion by using the metal mold where the protruded portions are formed by press fitting the pins into the press fit holes formed at the block, the crimp terminal according to the present invention can bring about the following advantages.

The circular press fit holes are opened, with the drill, in positions corresponding to the protruded portions of the press metal mold and the lower half portion of the pin is press fitted into the press fit hole. Merely taking the above operations enables easily to prepare the press metal mold having the protruded portions. Then, pressing the conductor crimp portion by using the press metal mold enables to obtain the crimp terminal having, as the serrations, the recesses to which the protruded portions are transferred, on the inner surface of the conductor crimp portion.

In this case, the large chamfer portion is provided at the distal end peripheral edge of the pin, and the proper-sized chamfer portion is provided at the hole edge of the press fit hole corresponding to the root of the protruded portion, thus enabling to form, at the inner periphery corner portion of the small circular recess of the conductor crimp portion, the roundness transferred by the chamfer portion at the distal end peripheral edge of the pin and enabling to form, at the hole edge of the small circular recess 20, the erect edge transferred by the chamfer portion of the hole edge of the press fit hole.

As a result, at the time of the crimping, the conductor having entered into the small circular recess is allowed to smoothly flow along the large roundness of the inner periphery corner portion of the recess, thus enabling to reduce the gap caused to the inner periphery corner portion. There was a fear that, in the case of a large gap, under the influence of the thermal shock, mechanical vibration or the like, the oxide film grows with the gap as a start point to thereby lower the contact conductivity between the conductor and the terminal. However, with realization of reducing the gap, the growth of the oxide film can be suppressed, thus enabling to maintain the good contact conduction performance for a long time.

Since the hole edge of the small circular recess is formed with the erect edge, the erect edge is allowed to eat into the conductor at the time of crimping, and the portion serves as the start point of the extension of the conductor which is about to be deformed in the forward-rearward direction, thus enabling to operate to better the peeling property of the oxide film of the surface of the conductor. As a result, the contact resistance increase which may be caused when the thermal shock or the mechanical vibration is received can be suppressed, thus enabling to maintain the stable conduction performance.

Forming, in the press metal mold, the protruded portions by the completely circular pins makes the protruded portions hardly cracked, thus improving the durability of the metal mold. When the protruded portion of the metal mold is formed by the grinding, the roundness at the distal end peripheral edge of the protruded portion becomes small. However, when the protruded portion of the press metal mold is formed by press fitting the pin, the chamfer configuration at the distal end peripheral edge of the protruded portion can be arbitrarily set to be large. This can prevent the chipping (flying of the crack pieces) of the protruded portion of the press metal mold, thus enabling to increase the durability of the press metal mold.

If the pin constituting the protruded portion of the press metal mold should be cracked or worn away, replacing of merely the pin is enough, thus enabling to maintain the metal mold by incurring little cost.

DESCRIPTION OF EMBODIMENTS

Hereinafter, one embodiment of the present invention will be explained with reference to drawings.

Figure 1:
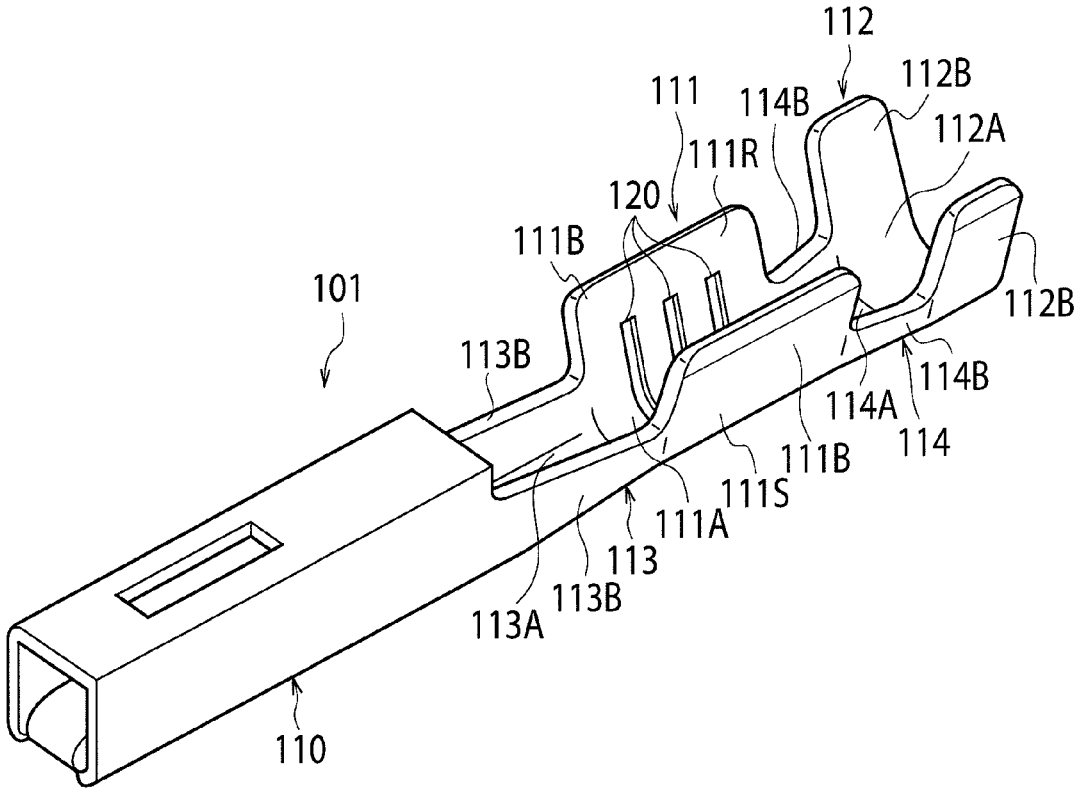
FIG. 1 is a perspective view showing a structure of an associated crimp terminal.
Figure 2:
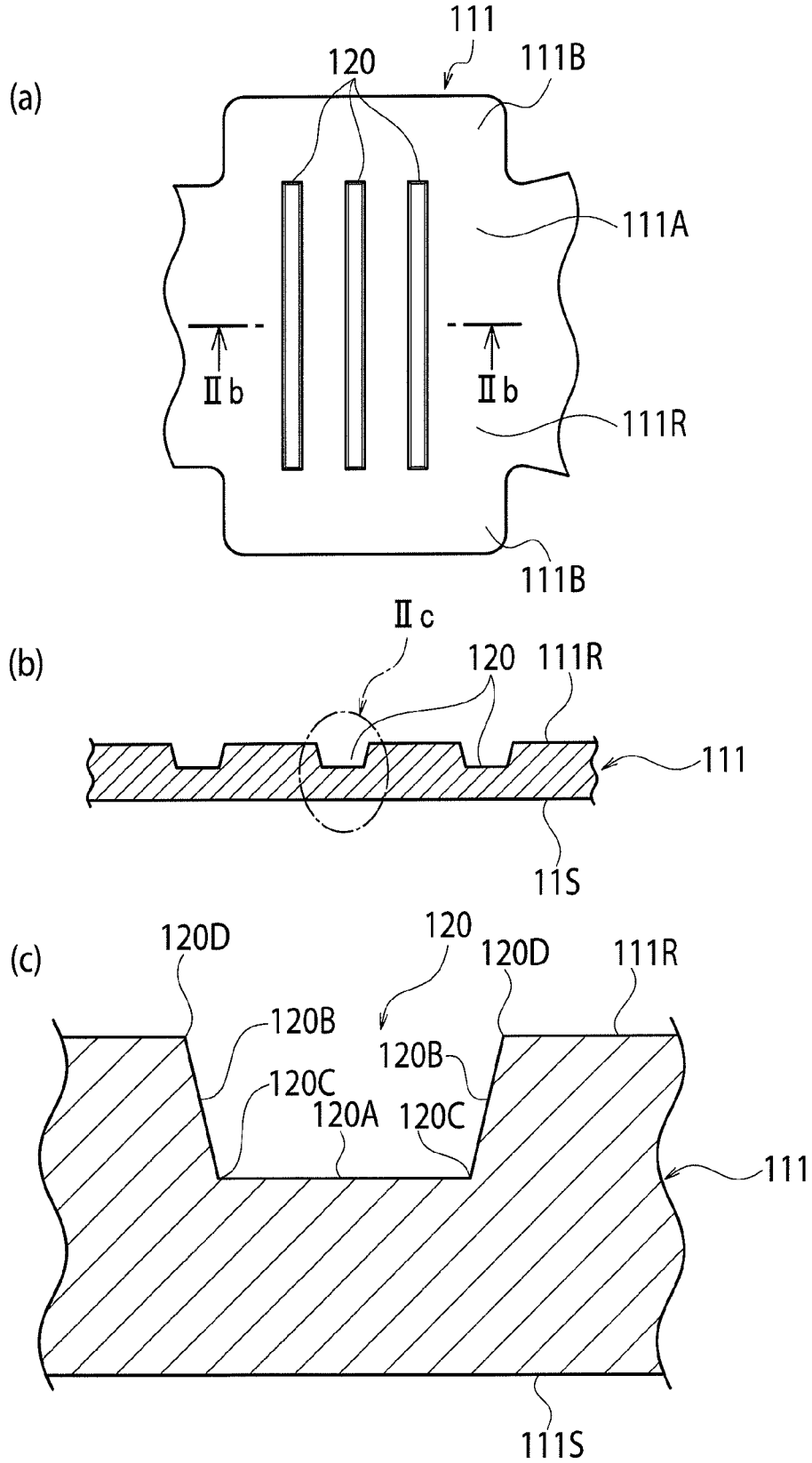
FIG. 2 shows a state before a conductor crimp portion of the crimp terminal in FIG. 1 is crimped, where (*a*) is a developed plan view, (*b*) is a cross sectional view taken along the line IIb-IIb in (*a*), and (*c*) is an enlarged view of a portion IIc in (*b*).
Figure 3:
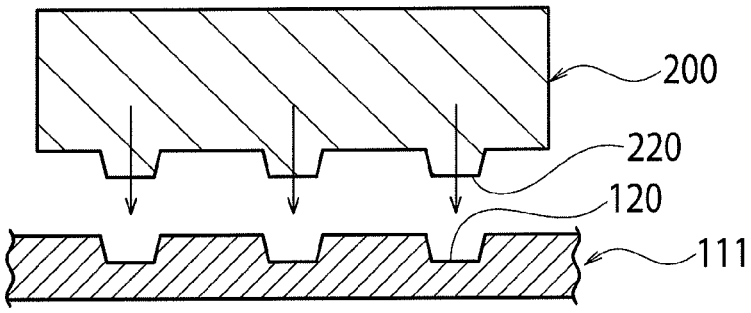
FIG. 3 is a cross sectional view showing a state where a serration of the conductor crimp portion in FIG. 1 is being press-machined.
Figure 4:
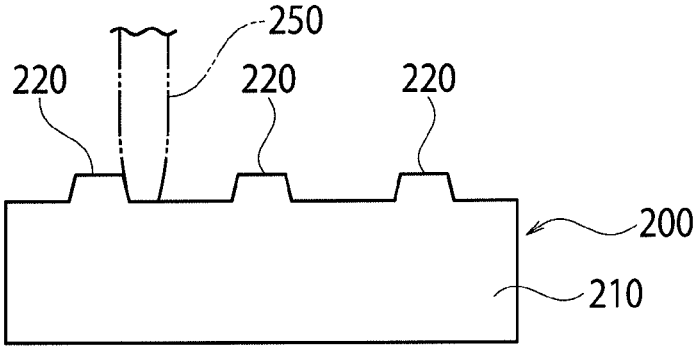
FIG. 4 is a side view showing that a protruded portion for machining the serration is being formed, by grinding, in a press metal mold used for the press-machining in FIG. 3.
Figure 5:
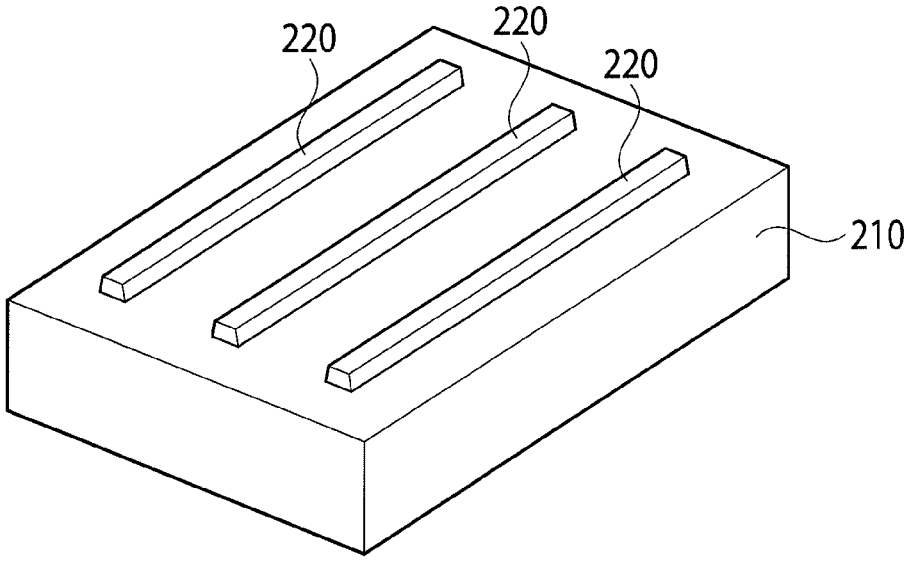
FIG. 5 is an external perspective view of the press metal mold produced through the machining in FIG. 4.
Figure 6:
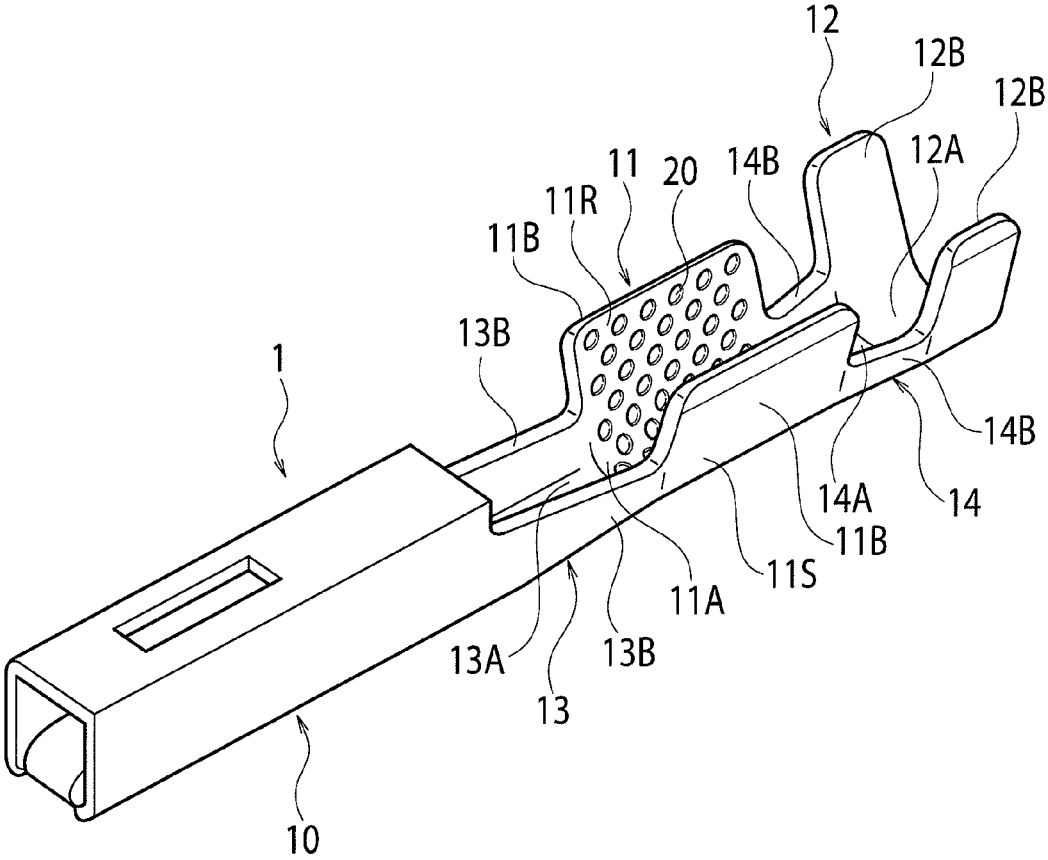
FIG. 6 is a perspective view showing a structure of a crimp terminal according to embodiments of the present invention.
Figure 7:
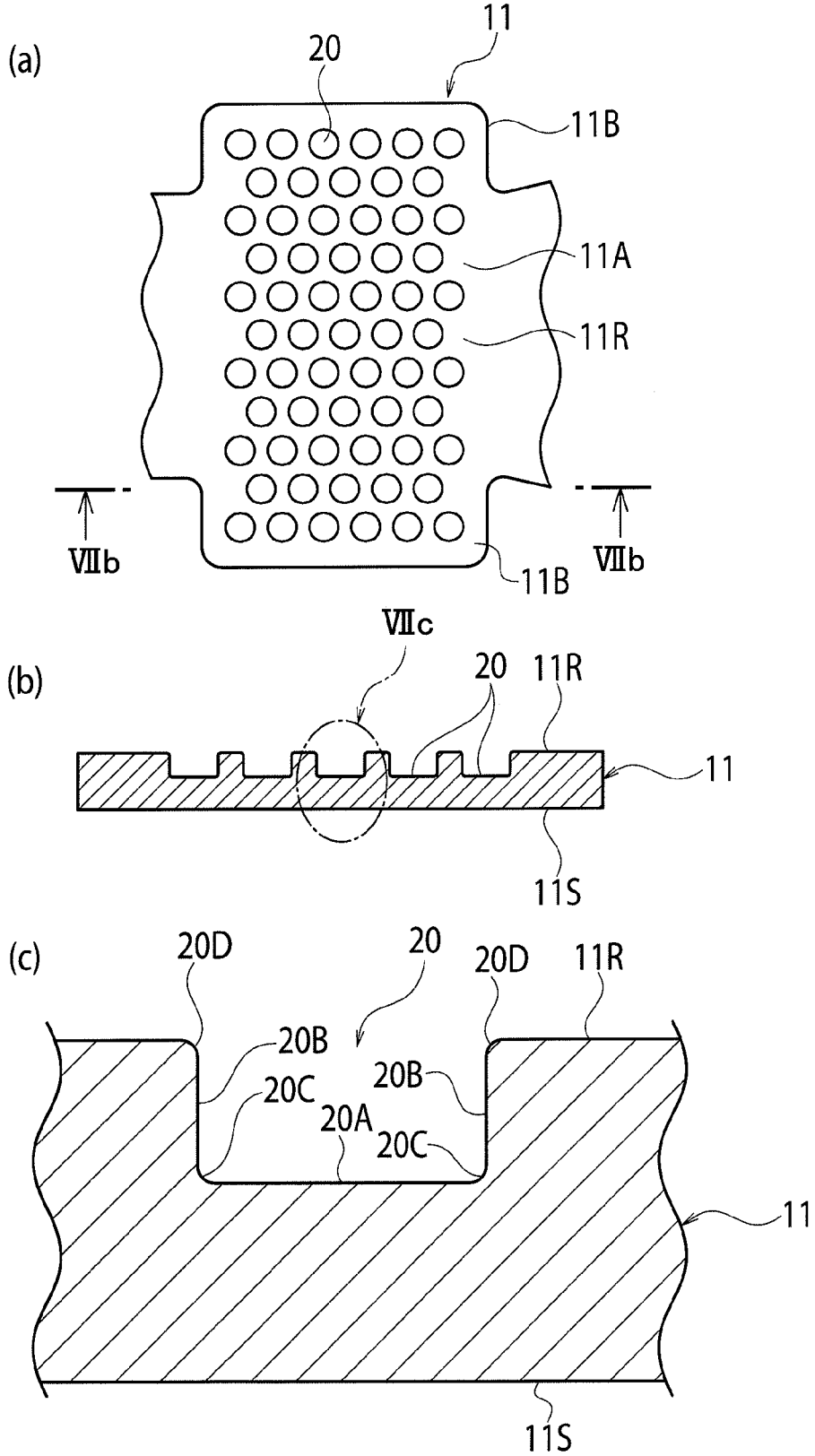
FIG. 7 shows a state before a conductor crimp portion of the crimp terminal in FIG. 6 is crimped, where (*a*) is a developed plan view, (*b*) is a cross sectional view taken along the line VIIb-VIIb in (*a*), and (*c*) is an enlarged view of a portion VIIc in (*b*).

FIG. 6 is a perspective view showing a structure of a crimp terminal according to the embodiments of the present invention. FIG. 7 shows a state before a conductor crimp portion of the crimp terminal is crimped, where FIG. 7(*a*) is a developed plan view, FIG. 7(*b*) is a cross sectional view taken along the line VIIb-VIIb in FIG. 7(*a*), and FIG. 7(*c*) is an enlarged view of a portion VIIc in FIG. 7(*b*).

As shown in FIG. 6, a crimp terminal 1 is one of a female type and is provided with: in the front portion in the longitudinal direction (also the longitudinal direction of a conductor of an electric wire to be connected, that is, an extending direction of the electric wire) of the terminal, a box-type electrical connection portion 10 to be connected to a male terminal on a mating connector side; behind the electrical connection portion 10, a conductor crimp portion 11 to be crimped to an exposed conductor Wa (refer to FIG. 11) of an end of an electric wire (not shown); and still behind the conductor crimp portion 11, a coated crimping portion 12 to be crimped to a portion, of the electric wire, coated with an insulative coating. Between the electrical connection portion 10 and the conductor crimp portion 11 is provided a first connecting portion 13 for connecting the electrical connection portion 10 with the conductor crimp portion 11. Between the conductor crimp portion 11 and the coated crimping portion 12 is provided a second connecting portion 14 for connecting the conductor crimp portion 11 with the coated crimping portion 12.

The conductor crimp portion 11, which has a bottom plate 11A and a pair of conductor crimping pieces 11B, 11B provided to extend upwardly from right and left side edges of the bottom plate 11A and to be so crimped as to wrap the conductor of the electric wire positioned on an inner surface of the bottom plate 11A, is formed substantially into a U-shape in cross section. The coated crimping portion 12, which has a bottom plate 12A and a pair of coated crimping pieces 12B, 12B provided to extend upwardly from right and left side edges of the bottom plate 12A and so crimped as to wrap an electric wire (a portion with an insulative coating) positioned on an inner surface of the bottom plate 12A, is formed substantially into a U-shape in cross section.

The first connecting portion 13 on the front side of the conductor crimp portion 11 and the second connecting portion 14 on the rear side of the conductor crimp portion 11, which, respectively, have bottom plates 13A, 14A and low side plates 13B, 14B erect upwardly from right and left side edges of the bottom plates 13A, 14A, are each formed substantially into a U-shape in cross section.

A bottom plate in a range from a bottom plate (not shown) of the electrical connection portion 10 in the front portion to the coated crimping portion 12 in the rearmost portion (the bottom plate 13A of the first connecting portion 13, the bottom plate 11A of the conductor crimp portion 11, the bottom plate 14A of the second connecting portion 14, and the bottom plate 12A of the coated crimping portion 12) is formed continuously in a form of one piece of band plate. The front and rear ends of the low side plate 13B of the first connecting portion 13 are continuous with respective lower half portions at a rear end of a side plate (no reference numeral) of the electrical connection portion 10 and at a front end of the conductor crimping piece 11B of the conductor crimp portion 11, while the front and rear ends of the low side plate 14B of the second connecting portion 14 are continuous with respective lower half portions at a rear end of the conductor crimping piece 11B of the conductor crimp portion 11 and at a front end of the coated crimping piece 12B of the coated crimping portion 12.

With the conductor crimp portion 11 in a state before being crimped to the conductor of the electric wire, on an inner surface 11R (of the inner surface 11R and an outer surface 11S of the conductor crimp portion 11) on a side contacting the conductor of the electric wire, many small circular recesses 20, as recess-shaped serrations, are so provided as to be scattered about in a zigzag form, in a state of being spaced apart from each other.

As shown in FIG. 7, each of the small circular recesses 20 has a cross section which is either rectangular or inverted trapezoidal, where an inner bottom surface 20A of the recess 20 is so formed as to be substantially parallel to the outer surface 11S of the conductor crimp portion 11. An inner periphery corner portion 20C where an inner side surface 20B and the inner bottom surface 20A of the recess 20 intersect with each other is provided with a roundness for connecting the inner bottom surface 20A with the inner side surface 20B by a smooth continuous curved surface.

Figure 8:
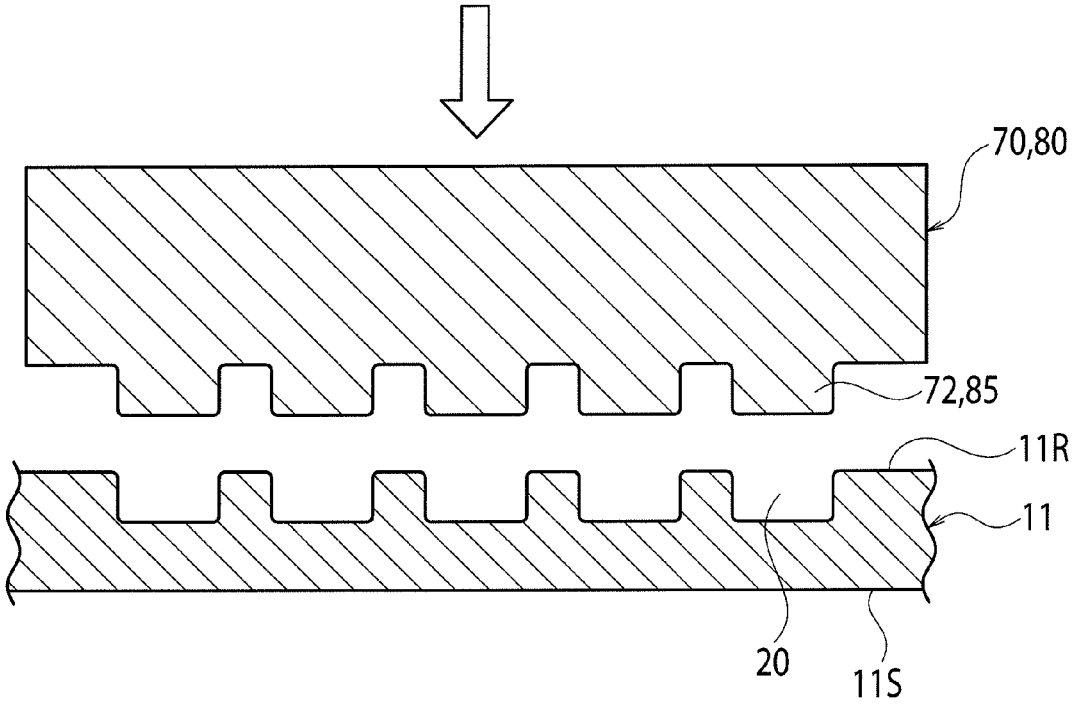
FIG. 8 is a side sectional view for explaining the forming of a small circular recess of the conductor crimp portion of the crimp terminal in FIG. 6 by a press metal mold having a protruded portion.

The serration (the recess 20) of the conductor crimp portion 11 is, as shown in FIG. 8, prepared by press machining the conductor crimp portion 11 with metal molds 70, 80 having many cylindrical protruded portions 72, 85 corresponding to the recesses 20. A roundness of the inner periphery corner portion 20C of the recess 20 is machined by previously adding a roundness to a distal end peripheral edge of each of the cylindrical protruded portions 72, 85 of the metal molds 70, 80.

Figure 9:
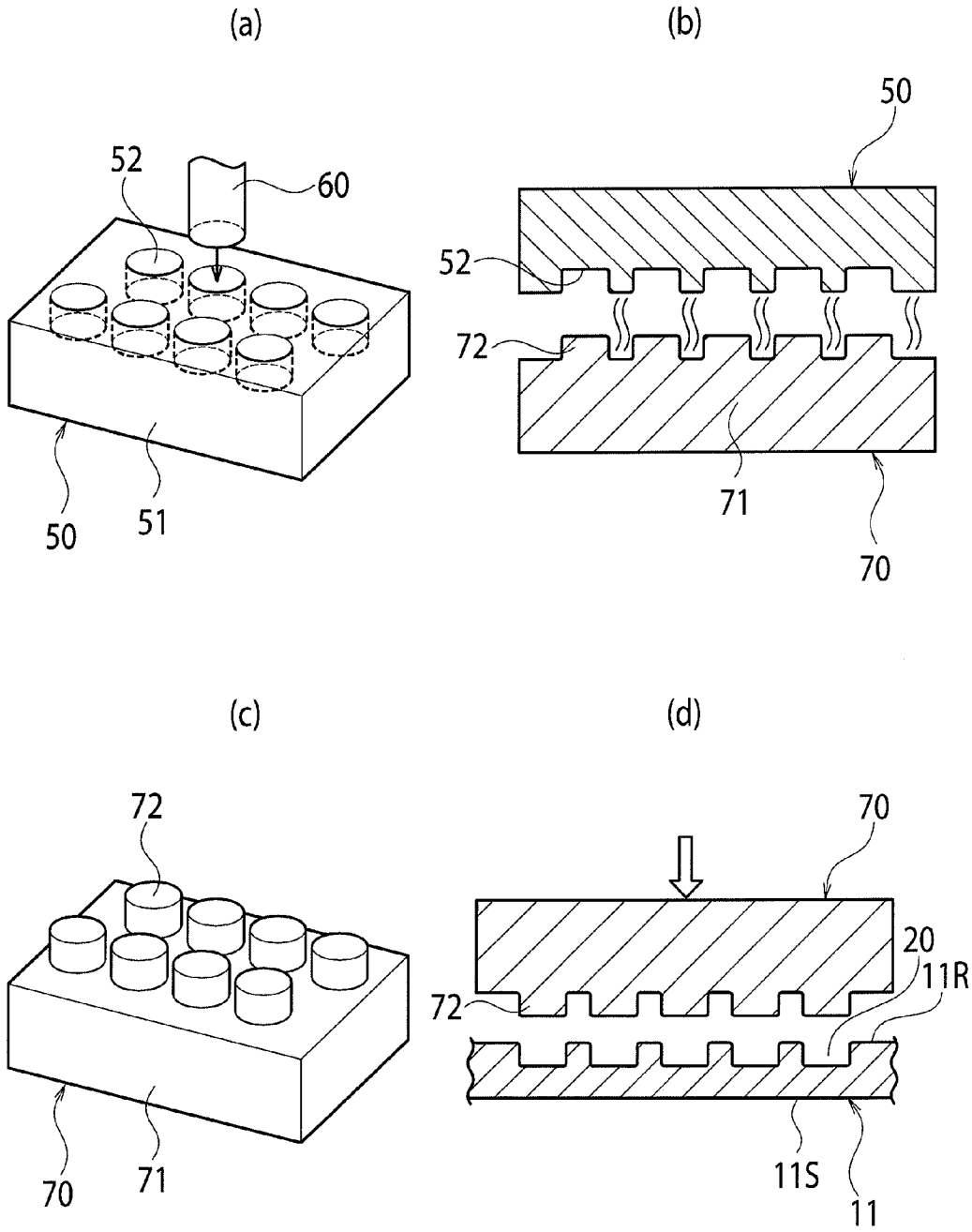
FIG. 9 shows processes until the crimp terminal according to the first embodiment of the present invention is formed, where (*a*) to (*d*) explain from preparing the press metal mold by a discharge machining until the conductor crimp portion is press-formed by using the press metal mold.

Herein, the press metal mold 70 used according to the first embodiment is made by a discharge machining. In this case, as shown in FIG. 9(*a*), as an electrode 50, a circular recess 52 (round hole) for making the cylindrical protruded portion 72 of the metal mold is machined with a drill 60 on an upper surface of a base material block 51. Then, as shown in FIG. 9(*b*), by using the electrode 50 having many small circular recesses 52 machined with the drill 60, the discharge machining is implemented on the base material block 71 of the metal mold 70 as a work and then unnecessary portions are melted, to thereby make the press metal mold 70 having many cylindrical protruded portions 72.

Figure 10:
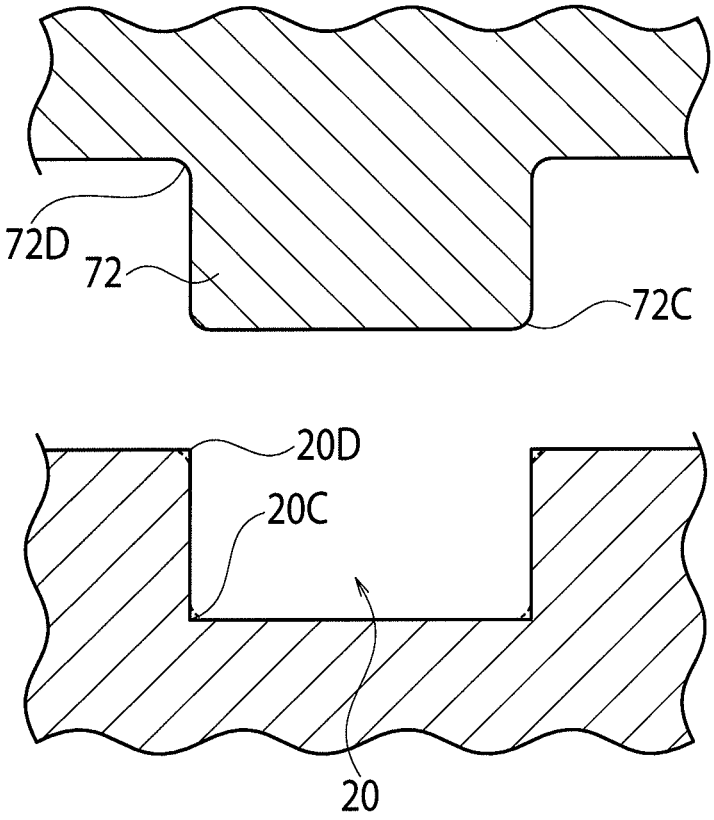
FIG. 10 is an enlarged cross sectional view showing the protruded portion of the metal mold relative to the small circular recess of the conductor crimp portion, in the press forming.

Then, as shown in FIG. 10, due to the characteristic of the discharge machining, the roundness is naturally formed at the distal end peripheral edge 72C of the press metal mold 70. Further, a small roundness corresponding to a hole edge of a drill hole (recess 52) of the electrode 50 is formed at a root outer periphery 72D of the cylindrical protruded portion 72 of the press metal mold 70.

Thus, as shown in FIG. 7 and FIG. 9(*d*), press-machining the conductor crimp portion 11 by using the metal mold 70 can transfer the roundness to the inner periphery corner portion 20C of the small circular recess 20 and transfer the small roundness to the hole edge 20D of the small circular recess 20.

For crimping the conductor crimp portion 11 of the crimp terminal 1 to the conductor of the end of the electric wire, the crimp terminal 1 is mounted on a mounting surface (upper surface) of a not-shown lower mold (anvil), then the conductor of the end of the electric wire is inserted between the conductor crimping pieces 11A of the conductor crimp portion 11, and then the conductor of the end of the electric wire is mounted on the upper surface (inner surface 11R) of the bottom plate 11A. Then, lowering the upper mold (crimper) relative to the lower mold allows a guide inclined surface of the upper mold to gradually bring down a distal end side of the conductor crimping piece 11B inwardly.

Then, with the upper mold (crimper) further lowered relative to the lower mold, finally, the distal end of the conductor crimping piece 11B is so rounded as to be folded back to the conductor side, by a curved surface continuous from the guide inclined surface to a central mountain-shaped portion of the upper mold, and the distal ends of the conductor crimping pieces 11B frictionally mated with each other are made to eat into the conductor, to thereby crimp the conductor crimping piece 11B in such a manner as to wrap the conductor.

The above operations can connect, by the crimping, the conductor crimp portion 11 of the crimp terminal 1 to the conductor of the electric wire. With respect to the coated crimping portion 12 as well, the lower mold and the upper mold are used to gradually bend the coated crimping pieces 12B inwardly, to thereby crimp the coated crimping pieces 12B to the portion, of the electric wire, coated with the insulative coating. By these operations, the crimp terminal 1 can be electrically and mechanically connected to the electric wire.

The crimp terminal 1 can bring about the following effects.

When the conductor crimp portion 11 is crimped to the conductor of the electric wire by using the crimp terminal 1, the conductor of the electric wire, while causing a plastic deformation, enters into each of the small circular recesses 20 provided, as serrations, on the inner surface 11R of the conductor crimp portion 11, to thereby strengthen the joint between the terminal and the conductor. In this case, the surface of the conductor caused to flow by the pressing force has a frictional mating with the hole edge 20D of each of the recesses 20 or the surface of the conductor entering into the recess 20 causes a frictional mating with the inner side surface 20B of the recess 20, thereby causing an oxide film of the surface of the conductor to be peeled off and an exposed new generated surface to have a contact conduction with the terminal. In addition, since many small circular recesses 20 are so provided as to be scattered about, a total length of the hole edge 20D of the recess 20 produces effectiveness in scraping off the oxide film, irrespective of the extending direction of the conductor. Thus, the contact conduction effect by the exposure of the new generated surface can be increased than when the linear serration intersecting with the direction, in which the conductor of the electric wire extends, is provided like the associated example.

In the case of the press-machining of the linear serrations like the ones according to the associated example, it was necessary to preform the linear protruded portions in the press metal mold. Therefore, the machining of the protruded portions had no choice but to rely on the grinding. However, in the case of making many small circular protruded portions 72 in the press metal mold 70 for machining the serrations, it becomes easy to rely on a machining method other than the grinding.

For example, in the case of forming, in the press metal mold, linear protruded portions like the ones according to the associated example, it is necessary to preform linear recesses at the discharge electrode for making the protruded portions by the discharge machining. However, as a matter of fact, forming of the linear recesses at the metal block was so difficult that it was not proper for implementing the discharge machining.

However, in the case of making, in the press metal mold 70, many small circular protruded portions 72 for machining the serrations like the first embodiment, the protruded portions 72 of the press metal mold 70 can be made with ease by the discharge machining. That is, only previously machining many small circular recesses 52 (as round holes) by drilling at the base material block 51 of the electrode 50 enables to transfer many small circular protruded portions 72 to the press metal mold 70.

Since many small circular recesses 20 provided as the serrations are formed by pressing the conductor crimp portion 11 by using the press metal mold 70 where the protruded portions are formed, by the discharge machining, in positions corresponding to the recesses 20, the crimp terminal 1 according to the first embodiment can bring about the following advantages.

That is, implementing the discharge machining of the base material block 71 of the press metal mold 70 by using the electrode 50 where the round holes (the circular recesses 52) are opened, with the drill 60, in the positions corresponding to the protruded portions 72 of the press metal mold 70 enables to produce the metal mold 70 having the protruded portions 72 in positions corresponding to the respective round holes (the circular portions 52). Then, press-machining the conductor crimp portion 11 by using the press metal mold 70 enables to obtain the crimp terminal 1 having, as serrations, the small circular recesses 20 to which the protruded portions 72 are transferred, on the inner surface of the conductor crimp portion 11. In this case, the distal end peripheral edge 72C of each of the protruded portions 72 (of the metal mold 70) prepared by the discharge machining is naturally machined into a configuration with the roundness due to the characteristic of the discharge machining. The root outer periphery 72D of each of the protruded portions 72 of the press metal mold 70 prepared by the discharge machining is machined into a configuration with the small roundness corresponding to the hole edge of the round hole (the circular recess 52).

Thus, the hole edge 20D of the small circular recess 20 of the conductor crimp portion 11 to which the protruded portion 72 of the metal mold 70 is transferred is machined into the configuration with the small roundness corresponding to the root outer periphery 72D of the protruded portion 72, and the inner periphery corner portion 20C of the small circular recess 20 is machined into the configuration having the roundness corresponding to the distal end peripheral edge 72C of the protruded portion 72.

Figure 11:
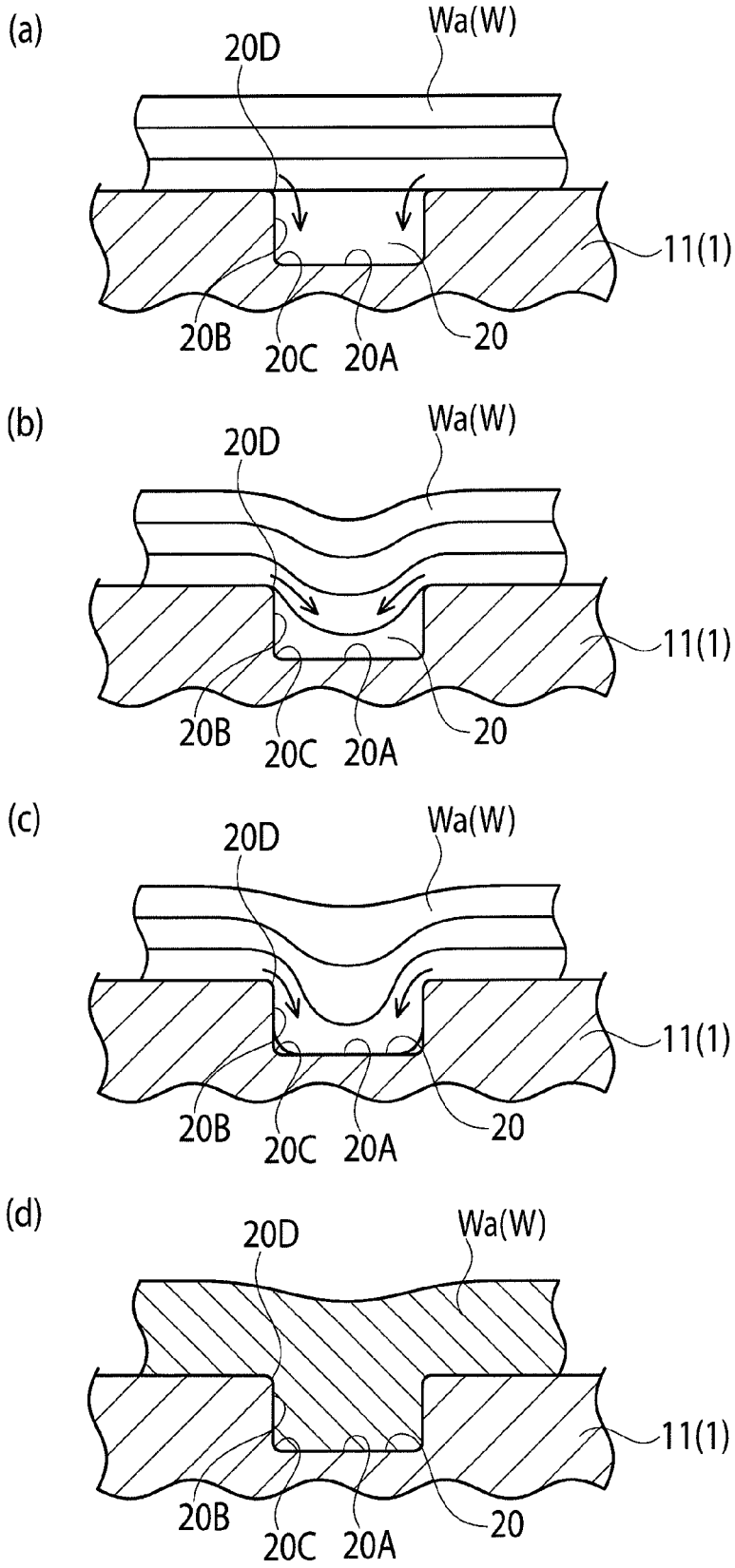
FIG. 11, regarding each (*a*) to (*d*), illustrates enlarged cross sectional views sequentially showing schematically a state in which the conductor, while causing a plastic deformation, enters into the small circular recess of the conductor crimp portion during the crimping.

As a result, at the time of the crimping, as shown in FIGS. 11(*a*) to (*d*), the conductor Wa having entered into the small circular recess 20 is allowed to smoothly flow along the roundness of the inner periphery corner portion 20C of the recess 20, thus enabling to reduce the gap caused to the inner periphery corner portion 20C. There was such a fear as, in the case of a large gap, being influenced by the thermal shock, mechanical vibration or the like, the oxide film grows with the gap as a start point to thereby lower the contact conductivity between the conductor and the terminal. However, realization of reducing the gap can suppress the growth of the oxide film, thus enabling to maintain a good contact conduction performance for a long time.

Since the hole edge 20D of the small circular recess 20 is machined into the configuration having the small roundness corresponding to the root outer periphery 72D of the protruded portion 72 of the press metal mold 70, at the time of crimping, the contact pressure to the conductor Wa by the hole edge 20D is increased, the force for pressing the conductor Wa which is about to be deformed in the forward-rearward direction is increased, and the frictional mating between the crimp terminal 1 and the conductor Wa flowing into the recess 20 or the conductor Wa extending in the forward-rearward direction outside the recess 20 can be promoted, thus enabling to better the peeling property of the oxide film. As a result, the contact resistance increase which may be caused when the thermal shock or the mechanical vibration is received can be suppressed, thus enabling to maintain the stable conduction performance.

Because of forming the completely circular protruded portion 72 in the press metal mold 70, the protruded portion 72 is hardly cracked, thus improving the durability of the metal mold 70. When the protruded portion of the metal mold is formed by the grinding, it is necessary to form the roundness at the distal end peripheral edge of the protruded portion by another process. However, when the cylindrical protruded portion 72 of the press metal mold 70 is formed by the discharge machining, the roundness at the distal end peripheral edge 72C of the cylindrical protruded portion 72 can be machined simultaneously.

Since the conductor crimp portion 11 of the crimp terminal 1 is machined by using the press metal mold 70 prepared by the discharge machining, the surface roughness of the inner surface of the conductor crimp portion 11 can be made rough, and the frictional force between the crimp terminal 1 and the conductor Wa can be increased, thus enabling to suppress the increase of the contact resistance.

The above description has been made about the case of the first embodiment for forming the crimp terminal 1 by using the press metal mold 70 prepared by the discharge machining. However, the crimp terminal 1 can be formed by a metal mold having another structure.

Figure 12:
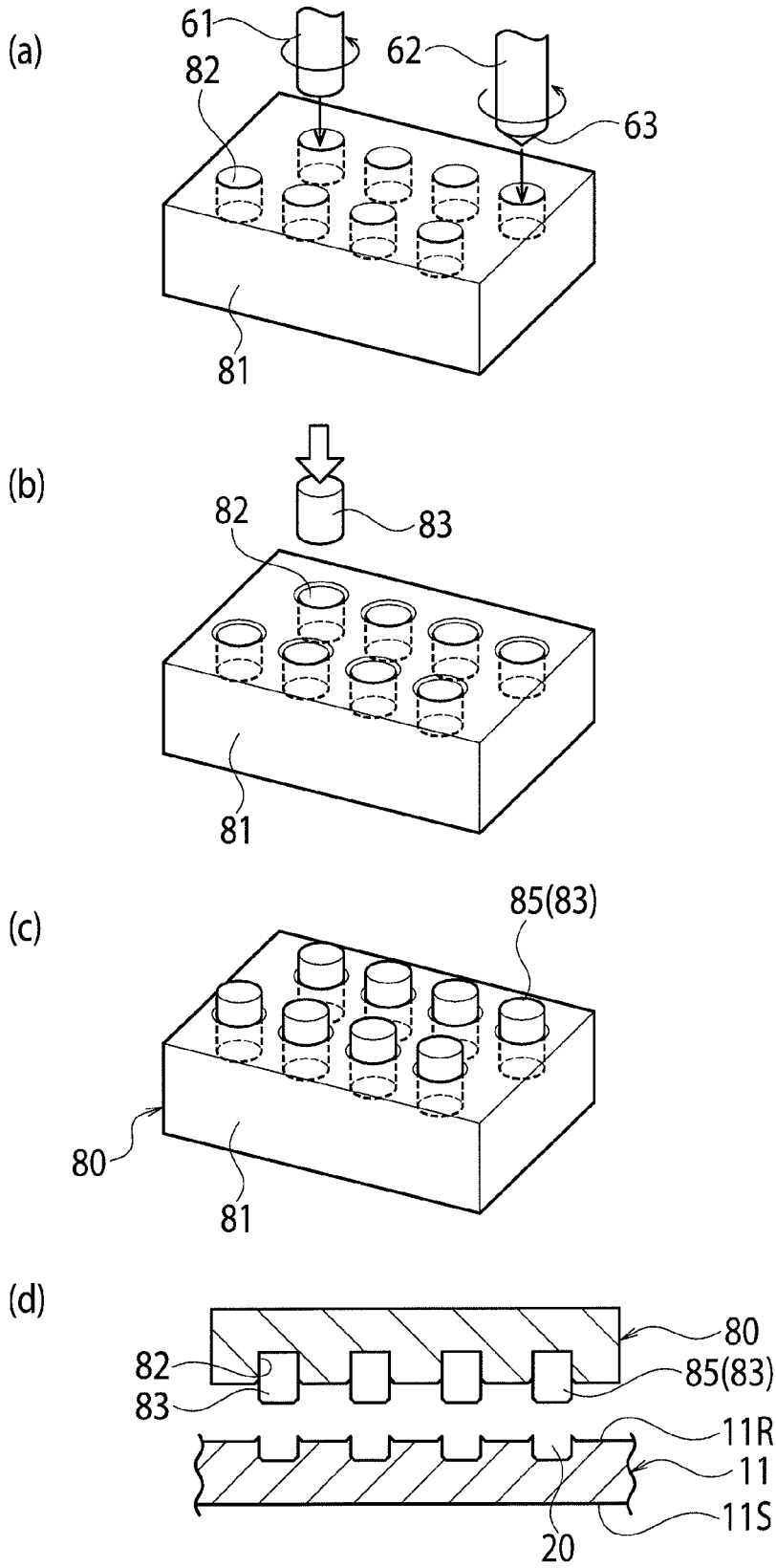
FIG. 12 shows processes until the crimp terminal according to the second embodiment of the present invention is formed, where (*a*) to (*d*) explain from producing the press metal mold by press fitting a pin into a base material block until the conductor crimp portion is press-formed by using the press metal mold.
Figure 13:
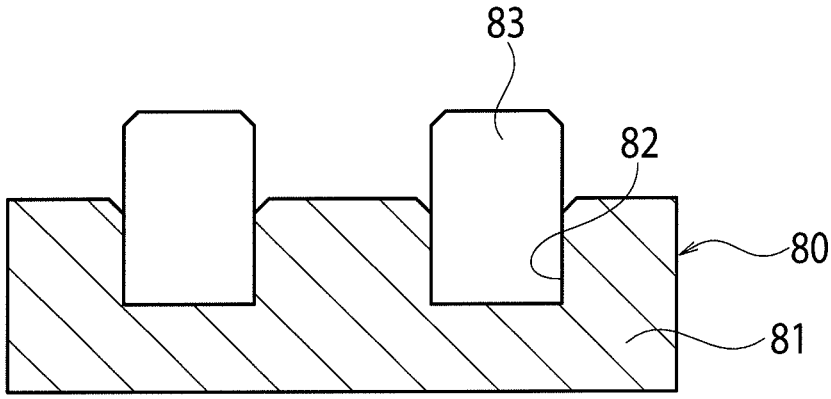
FIG. 13, (*a*) is a cross sectional view showing the base material block relative to the press fitted pin, and (*b*) is a partially enlarged cross sectional view of the above cross sectional view.
Figure 13:
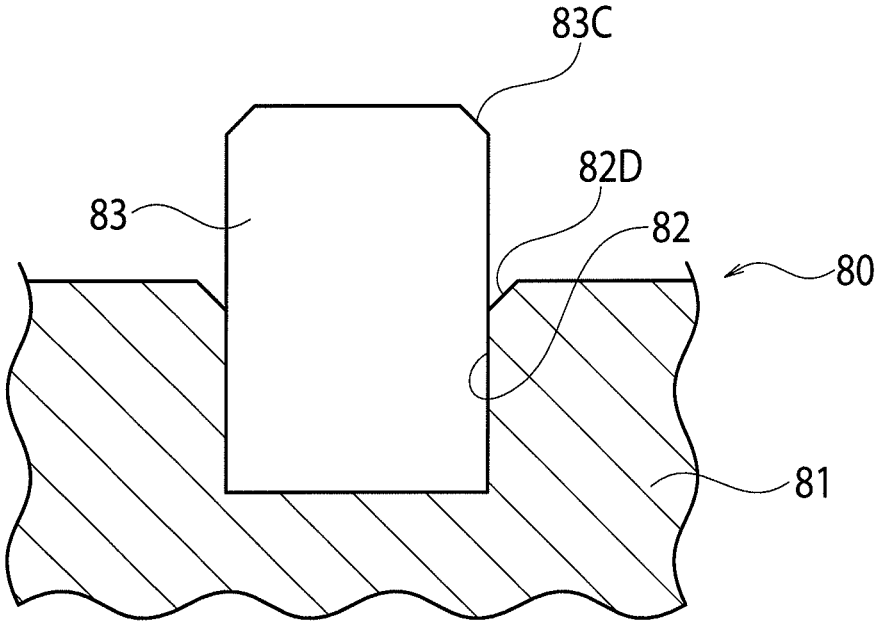

In the conductor crimp portion 11 of the crimp terminal 1 shown in FIG. 12, many small circular recesses 20 provided as the above serrations are formed in such a manner as that the lower half portion of a pin 83 is press-fitted to a press fit hole 82 formed at a base material block 81 to thereby press the conductor crimp portion 11 by using a metal mold 80 with protruded portions 85 formed at the positions corresponding to the recesses 20.

Herein, with respect to the press metal mold 80 in use, as shown in FIG. 12(*a*), the circular press fit hole 82 having a predetermined depth is drilled, with a drill 61, in an upper surface of the base material block 81 of the metal mold, and then, as shown in FIG. 12(*b*), the lower half portion of the cylindrical pin 83 is press-fitted into the press fit hole 82, to thereby prepare the press metal mold 80 having the protruded portions 85 including many pins 83 as shown in FIG. 12(*c*). In this case, a hole edge 82D of the press fit hole 82 is chamfered, and a distal end peripheral edge 83C of the pin 83 is chamfered.

Figure 14:
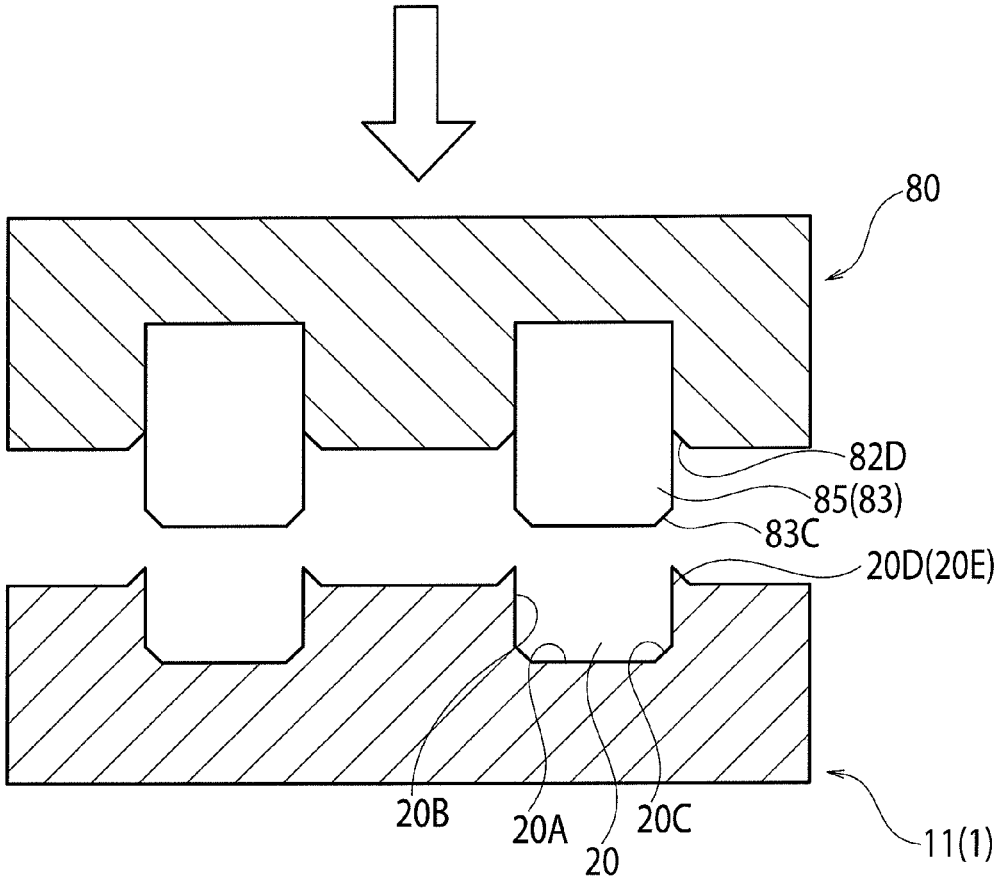
FIG. 14 is a cross sectional view of the small circular recess made by press machining the conductor crimp portion by using the metal mold.

Thus, as shown in FIG. 12(*d*) and FIG. 14, pressing the conductor crimp portion 11 by using the press metal mold 80 can transfer a large roundness (or chamfer) to the inner periphery corner portion 200 of the recess 20 and transfer an erect edge 20E to the hole edge 20D of the small circular recess 20.

Next, for crimping the conductor crimp portion 11 of the crimp terminal 1 to the conductor of the end of the electric wire, the crimp terminal 1 is mounted on a mounting surface (upper surface) of a not-shown lower mold (anvil), then the conductor of the end of the electric wire is inserted between the conductor crimping pieces 11A of the conductor crimp portion 11, and then the conductor of the end of the electric wire is mounted on the upper surface (inner surface 11R) of the bottom plate 11A. Then, lowering the upper mold (crimper) relative to the lower mold allows the guide inclined surface of the upper mold to gradually bring down the distal end side of the conductor crimping piece 11B inwardly.

Then, with the upper mold (crimper) further lowered relative to the lower mold, finally, the distal end of the conductor crimping piece 11B is so rounded, by the curved surface continuous from the guide inclined surface to the central mountain-shaped portion of the upper mold, as to be folded back to the conductor side, and the distal ends of the conductor crimping pieces 11B being frictionally mated with each other are made to eat into the conductor, to thereby crimp the conductor crimping piece 11B in such a manner as to wrap the conductor.

The above operations can connect, by the crimping, the conductor crimp portion 11 of the crimp terminal 1 to the conductor of the electric wire. With respect to the coated crimping portion 12 as well, the lower mold and the upper mold are used to gradually bend the coated crimping pieces 12B inwardly, to thereby crimp the coated crimping pieces 12B to the portion, of the electric wire, coated with the insulative coating. By these operations, the crimp terminal 1 can be electrically and mechanically connected to the electric wire.

In this way, the crimp terminal 1 formed by using the pin press-fit type metal mold can bring about the following effects.

In the case of forming, in the press metal mold, the linear protruded portions like the ones according to the associated example, for making the protruded portions by the press fitting of a rectangular die, it is necessary to preform the linear recesses at the base material bracket of the metal mold. However, as a matter of fact, forming of the linear recesses at the metal block was so difficult that it was not proper for implementing this machining method.

However, in the case of making many small circular protruded portions 85 in the press metal mold 80 for machining the serrations according to the second embodiment, the circular press fit holes 82 are opened, with the drill 61, in positions corresponding to the protruded portions 82 of the press metal mold 80 and the lower half portion of the pin 83 is press fitted to the press fit hole 82, thus enabling to easily prepare the press metal mold 80 having the protruded portions 85. Then, pressing the conductor crimp portion 11 by using the press metal mold 80 can obtain the crimp terminal 1 having, as the serrations, the recesses 20 to which the protruded portions 85 are transferred, in the inner surface of the conductor crimp portion 11.

In this case, as shown in FIG. 14, the large chamfer portion is provided at the distal end peripheral edge 83C of the pin 83, and the proper-sized chamfer portion is provided at the hole edge 82D of the press fit hole 82 corresponding to the root of the protruded portion 85, thus enabling to form, at the inner periphery corner portion 20C of the small circular recess 20 of the conductor crimp portion 11, the roundness (or chamfer portion) transferred by the chamfer portion at the distal end peripheral edge 83C of the pin 83 and enabling to form, at the hole edge 20D of the small circular recess 20, the erect edge 20E transferred by the chamfer portion of the hole edge 82D of the press fit hole 82.

Figure 15:
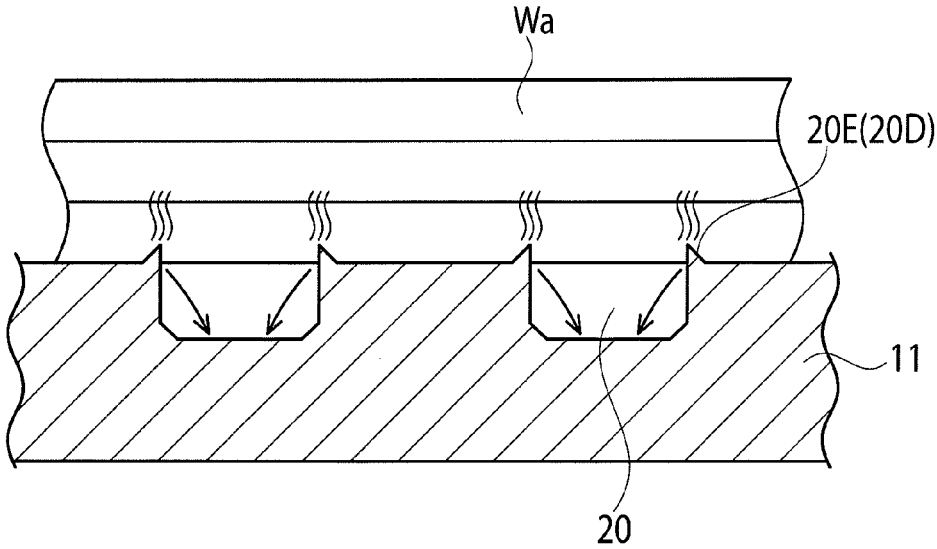
FIG. 15 is a schematic cross sectional view showing a state in which the conductor is pressed, during the crimping, to the recess which was formed as shown in FIG. 14.

As a result, at the time of the crimping, as shown in FIG. 15, the conductor Wa having entered into the small circular recess 20 is allowed to smoothly flow along the roundness of the inner periphery corner portion 20C of the recess 20, thus enabling to reduce the gap caused to the inner periphery corner portion 20C. There was a fear that, in the case of a large gap, under the influence of the thermal shock, mechanical vibration or the like, the oxide film grows with the gap as a start point to thereby lower the contact conductivity between the conductor Wa and the terminal. However, reducing the gap can suppress the growth of the oxide film, thus enabling to maintain the good contact conduction performance for a long time.

Since the hole edge 20D of the small circular recess 20 is formed with the erect edge 20E, the erect edge 20E is allowed to eat into the conductor Wa at the time of crimping, and the portion serves as the start point of the extension of the conductor Wa which is about to be deformed in the forward-rearward direction, thus enabling to operate to better the peeling property of the oxide film of the surface of the conductor Wa. As a result, the contact resistance increase which may be caused when the thermal shock or the mechanical vibration is received can be suppressed, thus enabling to maintain the stable conduction performance.

Forming, in the press metal mold 80, the protruded portions 85 by the completely circular pins 83 can make the protruded portions 85 hardly cracked, thus improving the durability of the metal mold 80. When the protruded portion of the metal mold is formed by the grinding, the roundness at the distal end peripheral edge of the protruded portion becomes small. However, when the protruded portion 85 of the press metal mold 80 is formed by press fitting the pin 83, the chamfer configuration at the distal end peripheral edge 83C of the protruded portion 85 can be arbitrarily set. This can prevent the chipping (flying of the crack pieces) of the protruded portion 85 of the press metal mold 80, thus enabling to increase the durability of the press metal mold 80.

If the pin 83 constituting the protruded portion 85 of the press metal mold 80 should be cracked or worn away, replacing of only the pin 83 is enough, thus enabling to maintain the metal mold 80 by incurring little cost.

According to the embodiments, the crimp terminal 1 is defined as a female terminal metal fitting having the box-type electrical connection portion 10. However, not limited to female, the crimp terminal 1 may be a male terminal metal fitting having a male tab or what is called an LA terminal with a through hole formed at a metallic plate material. That is, as needed, the crimp terminal 1 may be one having an arbitrary configuration.

As set forth above, the embodiments of the present invention have been explained. However, the present invention is not limited to the above embodiments, but various modifications are allowed.

The invention claimed is:

1. A crimp terminal comprising:

an electrical connection portion provided in a front portion in a longitudinal direction of the terminal; and a conductor crimp portion provided behind the electrical connection portion and crimped and connected to a conductor of an end of an electric wire, the conductor crimp portion having a cross section formed into a U-shape by a bottom plate and a pair of conductor crimping pieces provided to extend upwardly from both right and left side edges of the bottom plate and crimped to wrap the conductor disposed on an inner surface of the bottom plate, wherein the conductor crimp portion before being crimped to the conductor of the end of the electric wire includes, in an inner surface of the conductor crimp portion, circular recesses as serrations scattered to be spaced from each other, wherein each of the recesses is formed through a press machining of the conductor crimp portion by using a metal mold with a protruded portion formed, by a discharge machining, in a position corresponding to each of the recesses, and wherein each of the recesses has an inner periphery corner portion with a roundness corresponding to an outer periphery of a root of the protruded portion of the metal mold and a hole edge with a roundness corresponding to a peripheral edge of a distal end of the protruded portion of the metal mold.

2. A crimp terminal comprising:

an electrical connection portion provided in a front portion in a longitudinal direction of the terminal; and a conductor crimp portion provided behind the electrical connection portion and crimped and connected to a conductor of an end of an electric wire, the conductor crimp portion having a cross section formed into a U-shape by a bottom plate and a pair of conductor crimping pieces provided to extend upwardly from both right and left side edges of the bottom plate and crimped to wrap the conductor disposed on an inner surface of the bottom plate, wherein the conductor crimp portion before being crimped to the conductor of the end of the electric wire includes, in an inner surface of the conductor crimp portion, circular recesses as serrations scattered to be spaced from each other, wherein each of the recesses is formed through a press machining of the conductor crimp portion by using a metal mold with a protruded portion formed, by press fitting a pin into a press fit hole formed in a block, in a position corresponding to each of the recesses, and wherein each of the recesses has an inner periphery corner portion with a roundness corresponding to a chamfer portion of a peripheral edge of a distal end of the pin and a hole edge formed with an erect edge corresponding to a chamfer portion provided at a hole edge of the press fit hole.

* * * * *